United States Patent [19]

Szabo

[11] 4,019,558

[45] Apr. 26, 1977

[54] METHOD OF FORMING FOUNDRY MOULDS

[75] Inventor: Ervin I. Szabo, Manotick, Canada

[73] Assignee: Canadian Patents and Development Limited, Ottawa, Canada

[22] Filed: Aug. 20, 1976

[21] Appl. No.: 716,356

[30] Foreign Application Priority Data

Sept. 26, 1975 Canada ..... 236501

[52] U.S. Cl. ..... 164/26

[51] Int. Cl.[2] ..... B22C 9/04

[58] Field of Search ..... 164/26, 25, 361; 260/DIG. 40

[56] References Cited

UNITED STATES PATENTS

| | | | |
|---|---|---|---|
| 2,806,269 | 9/1957 | Dunlox | 164/26 |
| 3,005,244 | 10/1961 | Erdle et al. | 164/26 |
| 3,077,648 | 2/1963 | Sutherland | 164/26 |
| 3,396,775 | 8/1968 | Scott | 164/26 |
| 3,748,156 | 7/1973 | Moore, Jr. | 164/26 X |
| 3,894,572 | 7/1975 | Moore, Jr. | 164/26 |

FOREIGN PATENTS OR APPLICATIONS

| | | | |
|---|---|---|---|
| 2,251,050 | 4/1973 | Germany | 164/25 |

*Primary Examiner*—Ronald J. Shore
*Attorney, Agent, or Firm*—Francis W. Lemon

[57] ABSTRACT

A method of forming investment casting shell moulds by alternately dip coating a mould former in slurries of refractory particles and stucco coating the former, wherein the slurries contain a binder and a thixotropic modifier to reduce or eliminate the drying period between dip coats. The initial slurry has a suspended solids content in the range 30% to 50% by volume of the total volume of the slurry to provide an initial coating on the former which will not be penetrated by the relatively coarser stucco particles, while the other slurries have a suspended solids content in the range 20 to 40% by volume of the total volume of the slurry to coat the previously applied stucco coating. The thixotropic modifier is at least one substance selected from aluminum alkoxides, aluminum aryloxides, clays, carbon blacks, fumed silicas, fumed alumina, fumed titanium oxide, fumed zirconium oxide, fumed hafnium oxide and fumed chromium oxide.

6 Claims, No Drawings

METHOD OF FORMING FOUNDRY MOULDS

This invention relates to a method of forming foundry moulds.

Investment casting foundry moulds for precision investment casting are usually prepared by dipping a meltable mould former into a slurry containing the refractory particles and a binder to form a coating thereon, allowing the binder to set the coating, repeating the dipping and setting steps until a foundry mould is formed by the successive coatings, drying the foundry mould, and then melting and removing the mould former from the foundry mould.

While this method has proved very useful, the time required between each dip coating to allow each coating to dry has been found to be sufficiently long to make the process undesirably slow and costly.

Basically, the conventional foundry mould shell consists of alternating layers of fine and relatively coarse refractory particles, held in place by a suitable refractory binder. The first coating, which initially is in actual contact with the meltable mould former, and subsequently with the molten metal it will contain and shape, must perforce be of fine texture to repeat the meltable mould former pattern in faithful detail. The first coating is applied to the meltable mould former in the form of a slurry of maximum solids content consistent with adequate fluidity. This initial coating is then topped with a stucco layer of relatively coarser refractory particles.

The stucco layer of relatively coarse refractory particles fulfils a multiplicity of roles, namely:

i. It thickens the foundry mould shell, thereby strengthening it.

ii. It soaks up some of the suspending fluid from a slurry coating applied thereto and thus increases its viscosity and accelerates the arrest of draining of the suspending fluid.

iii. It forms nuclei on which shrinkage cracks may initiate. The cracks therefore will be numerous and small and cannot be penetrated by the liquid metal (under normal casting pressures).

iv. The rough surface to a small extent promotes drying.

v. The rough surface also provides a "key" for the next slurry coating.

vi. It may, by judicious selection, also promote the eventual removal of the foundry mould shell from the solidified metal casting therein.

The conventional method of placing the relatively coarse refractory particles on the slurry-wetted mould former varies, but in a great number of cases consists of immersing the slurry-wetted mould former in a fluidized mass of the stucco particles. In some instances, however, the first stucco layer is applied by "raining" the refractory particles on the slurry wetted mould former. The reason for this is said to be twofold:

a. in a fluidized bed the high air velocity imparts a great momentum to the refractory particles and may cause penetration through the initial slurry, coating and b. the high air velocity may also dry the initial slurry coating, causing the formation of a dry skin on the mould former to which the stucco refractory particles will not adhere.

Following the application of the stucco layer, the coated mould former is alowed to dry. During this period the siliceous binder sets; in aqueous colloidal silica-based suspensions, by the progressive rejection of silica from the colloid; in the case of ethyl silicate-based suspensions, drying and simultaneous hydrolysis (as the alkoxide reacts with atmospheric moisture) also takes place.

When the siliceous binder is fully set, the mould former is usually immersed in a second refractory particle slurry, and then re-stuccoed, and these step repeated sequentially a number of times until a sufficiently strong foundry mould is formed. The second slurry and subsequent ones are conventionally thinner than the one employed for the initial coating, partly to compensate for the increase in concentration that takes place when a portion of the liquid vehicle is soaked up by the dry layers underneath, and partly due to the realization that the firm first layer forms an adequately strong barrier against stucco particle penetration. Thus the advantage of speedy draining offered by thinner suspensions can be readily exploited. The protection afforded by the firm, initial coating also permits a stucco of relatively coarser refractory particles to be used. Again, drying follows.

It is evident that, as previously stated, drying is the most time-consuming period of the foundry mould preparation; furthermore, the repeated handling for each and every dip/stucco layer adds to the cost of production.

Various methods have been proposed whereby successive layers of slurry/stucco may be applied to the mould former without drying in between the applications of the slurry coatings, and to deposit a thick, heavy layer sufficiently strong to withstand handling and to contain the molten metal, in order that great savings be realized. Such methods, if successful, would greatly reduce the time required for mould preparation and would also eliminate the need to store coated mould formers during drying, thus resulting in a substantial reduction in the size of the mould preparation area required.

It has been suggested that rapid hardening of the slurry would offer one means by which to arrive at the desired end, and that this may be accomplished either by speeding up the evaporative drying of the slurry coating, or speeding up the hardening of the slurry coating by chemical means.

The former approach has proved to be limited in its scope, because removal of the volatiles is dependent on air velocity, the heat supplied to the slurry coating, and the rate of capillary diffusion of the liquid from the interior of the coating to its surface. It has also been found that the cooling caused by evaporation from the slurry coating causes some shrinkage in a mould former of, say, wax and, hence, in the (still pliable) coating thereon. On regaining ambient temperature the pattern expands and cracks the (now rigid) coating thereon. This phenomenon imposes severe limits on the extent to which drying of a slurry coating can be accelerated.

Accelerated hardening of the slurry coating by chemical means is the method which is widely used, since both the colloidal silica and the partially hydrolized alkoxy silane can be made to reject the silicon dioxide binder with relative ease.

Another of the more commonly employed techniques involves the use of ammonia fumes to promote the decomposition of the organosilicate binder. This method, while rapid, necessitates the repeated handling of the workpiece on each and every occasion it has been given a slurry coat and subsequent stucco layer. It also necessitates the installation of the expensive, additional equipment (gas chamber, ammonia metering system and a satisfactory venting arrangement) in which to conduct the hardening treatment.

Foundry moulds which have been hardened in this manner tend to be weaker than those prepared from an identical suspension and coated with similar, relatively coarser stucco particles the same number of times, but allowed to dry between the application of slurry coatings.

Techniques have also been developed for the accelerated hardening of aqueous, silica-bonded slurry coats. These range from the relatively simple one of dusting alkali earth oxide or carbonate on the still wet slurry coating or possible mixing it into the fluidized stucco particle bed (in which instance the dust blown off must be periodically replenished), to the somewhat more elaborate ones which involve the use of a mixture of liquids and/or slurries. For example, mould formers may be coated with alternating layers of acidulated and alkaline slurries. Yet another technique utilizes an additional "dip," which hardens a slurry/stucco layer, after which the triple treatment of slurry/stucco/hardening dip is repeated. Care must be taken to avoid the contamination of the slurry by "dragout" of the "hardening" substance.

Whilst the processes outlines above do accelerate the hardening of the binder, they are not universally employed, owing to their various shortcomings.

It is an object of the present invention to provide an economical and simple method of forming foundry moulds wherein the time period for allowing a slurry coating to set is substantially reduced or eliminated without affecting the integrity of the foundry moulds thus produced.

According to the present invention there is provided a method of forming a foundry mould, comprising:

a. applying an initial coating of refractory particles, to a meltable mould former, from a slurry having a suspended solids content in the range 30 to 50% by volume of the total volume of the slurry, and containing a siliceous binder for the refractory particles and a thixotropic modifier for the slurry, then b. applying additional refractory particles to the mould former, in the form of a stucco layer of relatively coarser refractory particles, then c. applying a plurality of further coatings of refractory particles to the mould former to form a foundry mould, the further coatings comprising slurry coatings alternating with stucco layers of relatively coarser refractory particles, with each slurry coating being applied from a slurry having a suspended solids content in the range 20 to 40% by volume of the total volume of the slurry, and containing a siliceous binder for the refractory particles and a thixotropic modifier for the slurry, then d. allowing the coatings and layers to set and dry, and then e. heating the mould former to melt it and then removing the molten mould former material from the foundry mould, and wherein f. the thixotropic modifier comprises particles of at least one substance selected from the group consisting of aluminum alkoxides, aluminum aryloxides, clays, carbon blacks, fumed silicas, fumed alumina, fumed titanium oxide, fumed zirconium oxide, fumed hafnium oxide and fumed chromium oxide.

By the present invention, thixotropy is induced in each slurry coating and yet at the same time desirable properties of freely draining slurries are retained.

The phenomenon of thixotropy is exploited to advantage in, e.g., paint manufacture and soil drilling. In the former, paints rendered thixotropic can be applied in heavy layers even on vertical surfaces. The paint is sufficiently fluid during, and immediately after application to flow and yield a smooth coat without brush marks or blemishes, yet becomes "rigid" in a short while, and therefore does not sag. In well drilling thixotropic mud assists in the suspension and removal of debris generated during drilling and clays must be added (if absent from the soil) to induce thixotropy.

To introduce thixotropy into the suspension used in investment casting, slurries were employed with which the applicant has acquired some familiarity. Viscosity builders (or body builders) e.g., various colloid-forming substances were avoided. These additives, when incorporated in the suspension, render it sluggish, give it "body," but do not usually impart thixotropy. Various substituted cellulose derivatives, starches, etc., belong to this family of substances and can be obtained in water or organic solvent soluble formulations.

Aluminum hydroxide, which is compatible with the suspensions initially examined, is known to display thixotropic tendencies, when precipitated from its soluble salts. Thixotropy is thought to be the result of particle-to-particle electrostatic attraction. This attraction may be direct, or possible through the —OH: HO— and the envelope of water associated with the colloidal molecule.

The following experiments are given, by way of example, to illustrate the present invention.

In experiments leading to the present invention it was found that adding previously precipitated aluminum hydroxide to the alumina suspension and further milling did not produce a slurry suitable for the purpose intended. It was decided therefore to carry out further experiments wherein the hydroxide is precipitated in situ. It was found that the precipitation may be readily accomplished since aluminum hydroxide can be easily separated from aluminum compounds in solution often without the necessity of adding potentially interfering substances. This latter restriction limited the choice of usable aluminum compounds, since those which require the use of alkaline precipitants could also interfere with the colloidal silica already present in the suspension. Thixotropic modifiers which require careful handling, or are unduly hazardous (e.g., aluminum alkyls) were considered less attractive.

Tests have shown that aluminum alkoxides, in general, aluminum iso-propoxide in particular, are nigh innocuous substances, soluble in a number of organic liquids, and decompose readily in contact with water to yield aluminum hydroxide.

Optimum results were obtained when adding a small quantity of the alkoxide to the mixture of ingredients normally used, followed by milling for 48 to 72 hr. However, if a colloidal silica is used as the binder it must be an alcohol tolerant one because other colloidal silicas will produce gelling. A small reduction in the quantity of alumina had to be made, however, to compensate for the inceased viscosity noted. The quantity of thixotropic modifier needed to modify the properties of the slurry was found to be inversely proportional to the concentration of the total solids in the slurry. The following Table 1 shows the formulations of two milled suspensions based on 1034*a* grade colloidal silica (Nalco Chemical Co. Inc., Chicago, Ill.).

Table 1.

Thixotropic alumina and mullite suspensions

| | | | |
|---|---|---|---|
| 1034a colloidal silica | | 1500 ml | 1500 ml |
| Water | | 1250 ml | 1250 ml |
| Isopropanol* | | 250 ml | 250 ml |
| C71-FG alimina | Aluminum Co. of Canada Ltd. | 4000 g | — |
| C71-FG alumina** | | 2000 g | — |
| C71-FG alumina** | | 1000 g | — |
| SM-1 sintered mullite** | Cawood Wharton Co. Ltd Belvedere, Kent, England | — | 3000 g |
| SM-1 sintered mullite** | | — | 1000 g |
| SM-1 sintered mullite** | | — | 1000 g |
| Aluminum iso-propoxide* | | 40 g | 50 g |
| Aluminum stearate | | 20 g | 25 g |

** milling between additions
* aluminum iso-propoxide dispersed in isopropanol and added to the mixture.

It will be noted that the concentration of suspended solids as shown in Table 1 is lower than that used in other processes for producing foundry moulds by dip coating a mould former. This reduction is necessary, however, to compensate for the thickening action of the thixotropic modifier. Slurries heavily loaded, e.g., containing some 45–50% of suspended solids by volume, tend to become unmanageably sluggish when rendered thixotropic. The slurries shown contain approximately 37 and 40% of suspended solids by volume, assuming the colloidal silica to be entirely liquid. (The actual total solids content is somewhat higher; about 15% by volume of silica should be added to the total, which is the total solids content of the liquid vehicle. The residue of the thixotropic modifiers is negligible.)

Although the slurries, as prepared according to Table 1, exhibited an acceptable level of thixotropy, yet remained adequately fluid, initial attempts to deposit a multi-layered shell on bare wax mould formers were unsuccessful. When a number of coats were built up, the weight of the shell coating became apparently too heavy, and so it sloughed off the mould former. When, on the other hand, mould formers bearing a prime coat were used, this difficulty was not experienced. It would appear that the roughened texture offered by the initial coating and stucco substrate provided a good enough "key" and thus supported the layers above. It should also be mentioned that, in these trials, fused silica sand particle stuccoes were used. Particles of greater specific gravity were found to be too heavy to be supported by suspensions prepared as shown in Table 1. Even when using silica sand stuccoes, the coated mould formers exhibited a modest-to-pronounced taper in thickness of the shell coating. This, however, was not considered to be detrimental, since the extra strength provided by such a shell coating is precisely in the area of maximum liquistatic pressure.

To extend the range of usefulness of the present invention, tests were made to attempt the preparation of thixotropic slurries that required no milling, in addition to trying to eliminate the need for a pre-coated mould former to support the thixotropic shell coating thereon.

To achieve the first objective, it was attempted to add aluminum iso-propoxide to a mixed-only aqueous suspension. Stirring the mixture failed to produce a smooth, acceptable slurry, since the alkoxide reacted with the water and formed lumps which would not disperse. To ensure a uniform distribution in an easy manner, the reagent is preferably added in a finely subdivided form, preferably in the form of a solution.

Aluminum iso-propoxide can be taken up in a number of organic liquids. The choice fell on those which were readily available, as well as reasonably compatible with the system. Although isopropanol is a solvent for the alkoxide, the solubility is limited. A somewhat greater concentration of the reagent was found possible using a 1:1:1 mixture of isopropanol:diethyl ether:benzene. When added to the slurry as formulated in Table 1, (or others based on alcohol tolerant colloidal silica binders, but not necessarily containing alumina or mullite as the refractory powder) in a dropwise fashion whilst stirring vigorously, the resultant, mixed-only slurries, could be used for the rapid preparation of shell moulds (on pre-coated mould formers). Some differences were noted, but these could be attributed to the presence of foreign fluids not miscible with the main liquid vehicle of the slurry.

A further improvement of the technique was realized when the complete shell mould could be deposited on the bare mould former, i.e., it was no longer necessary to have a dry, solid prime coat to support the rest of the coatings and layers. Concurrently, it was also decided to separate the slurries which were used for coating the bare mould formers from those into which the stuccoed mould formers were dipped, since the latter invariably contained a small quantity of coarser material, the result of the inevitable shedding of loosely adhering grit on re-immersion into the tank.

The prime or initial coating was formulated to contain a sufficiently high volume fraction of solids to provide an effective barrier against the impingement of the sand particles when submerged in the fluidized bed. Yet at the same time a freely flowing suspension is necessary to ensure that it reproduces the pattern with the greatest fidelity. By increasing the concentration of the suspended solids to 43–46% by volume and reducing the quantity of the alkoxide (or other thixotropic modifier) by about half, a satisfactory prime slurry was produced. From the experiments it was found that the initial coating could be applied from a slurry having a total solids content in the range 30 to 50% by volume of the total volume of the slurry.

For the second, and subsequent coats, a thinner slurry was found desirable. In this instance the quantity of suspended solids was reduced to 30–35% by volume (again excluding the silica content of the sol). To maintain the necessary thixotropic "strength" of the slurry layer, the alkoxide was increased by about half. From these experiments it was deduced that the second and subsequent coats could be applied from a slurry having a suspended solids content in the range 20 to 40% by volume of the volume of the slurry.

It is stressed that these values were obtained empirically and refer to the types of suspensions used during the course of this work. Other refractory powders, binders, etc., will, or may, require different optimum quantities of vehicle or ratios of thixotropic modifier because the properties of slurries are influenced not only by the relative quantities of suspensoid and its carrier vehicle- but, among other things, by the fineness of the powders as well as by their morphology. Similarly the pH of the fluid will also have a bearing on the viscosity of the mixture. A small quantity of HCl, approximately 5 to 10 ml/l, will generally reduce slurry viscosity and thus promote draining of the excess as well as improve its ability to reproduce detail without materially interfering with the thixotropy of the mixture. It is also again stressed that for a desired "behavior" the quantity of thixotropic modifier needed is inversely proportional to the concentration of the suspensoid. Conditions resembling this statement were also noted elsewhere. However, the tests have shown that in general the second and subsequent coats can be applied from a slurry having a total solids content in the range 20 to 40% by volume of the total volume of the slurry.

Though the general limits of composition to formulate an acceptable slurry suspension are fairly wide, the preferred ones are much narrower. It has been noted that any selected two of the following three (solids content, level of thixotropy and quantity of modifier) tends to establish the unselected one. This was found to apply equally whether aluminum iso-propoxide was added, or other thixotropic modifiers employed during the course of these experiments were used. For instance, for mixed suspensions in an alcohol-based vehicle, 6–7 g/l of 100% compressed acetylene black per liter of vehicle for the first slurry and 10 g/l for the second, were found to produce acceptable results. Tables 2 and 3 provide more detailed data for the statement made above.

Table 2.

| Thixotropic slurries (acetylene black modified) | prime | back-up |
|---|---|---|
| Ethyl silicate-40 | 1000 ml | 1000 ml |
| Water (10 ml/l cone. HCl) | 200 ml | 200 ml |
| Isopropanol | 2000 ml | 3000 ml |
| C 71 FG alumina | 6500 g | 6500 g |
| Acetylene black (100% compressed) | 25 g | 40 g |

Coatings of sufficient thickness could be deposited on bare mould formers using the above slurries and stuccoing with S-1 grade fused silica (marketed by the Alchem Limited, Burlington, Ontario, Canada) between dips. It is also pointed out that the amount of carbon introduced by the acetylene black is quite small and is lost durng the burn-off period.

Comparable results may be obtained by substituting fumed silica in place of the acetylene black, as detailed in the following Table 3.

Table 3.

| Thixotropic slurries (fumed silica modified)* | prime | back-up |
|---|---|---|
| Ehtyl silicate-40 | 1000 ml | 1000 ml |
| Water (10 ml/l cone. HCl) | 200 ml | 200 ml |
| Isopropanol | 2000 ml | 3000 ml |
| C 71 FG alumina (Aluminum Co. of Canada Limited) | 6500 g | 6500 g |
| Aerosil 972 fumed silica (Degussa Frankfurt-am-Main, FDR) | 25 g | 40–50 g |

*provided that S-1 fused silica stucco (obtainable from Nalco Chemical Co. Inc. Chicago, Illinois) is used throughout.

Slurries have also been pepared using sintered mullite flower (−200 mesh) as the suspensoid. Allowances were made for the lower specific gravity of the latter. The reduction in weight did not follow the ratio of specific gravities; a somewhat greater concentration of the suspensoid was necessary, as well as a 10% increase in the thixotropic additive for results comparable with those with fine-ground alumina. Similar comments are applicable to suspensions containing P-1 W grade fused silica (obtainable from Nalco Chemical Co. Inc., Chicago, Ill.) i.e., the slightly different texture of the particles necessitated the addition of a greater quantity of fumed silica and/or acetylene black to impart the desired characteristics, as well as a slightly greater concentration of the suspended solids to match the behavior of the alumina-containing ones.

The formulations given in Tables 2 and 3 result in rapidly ageing slurries. Should more stable vehicles be desired, the proportion of the water must be reduced. It should also be noted that stirring times in these experiments were limited to about two hours; longer periods would allow a greater solid concentration for a given level of viscosity due to the dispersion of the agglomerates which are present in greater or smaller proportion in all finely divided substances.

The shell moulds deposited in this manner were generally between ⅜ and ½ in. (10 and 13 mm) thick, again being generally somewhat thicker on the bottom. As commented upon earlier, this is not thought to be a detriment, since it adds extra strength precisely where it is needed. The final coat deposited was a stucco layer. On occasion, difficulties were experienced with final slurry coats, since they tended to flake when dry. This is probably due to the fact that thixotropic slurries are also flocculated ones and, in these suspensions, re-arrangement and "nesting" of particles during drying is inhibited. It may therefore be necessary to apply the final slurry coat after some drying has taken place, and that it not be a thixotropic one.

The experiments showed that ideally a major portion of the thixotropic modifier comprises particles less than 10 microns in size and that the amount of thixotropic modifier present is inversely proportional to the total solids content of the slurry and for each liter of slurry is in the range 3 gms to 70 gms.

Thus the thixotropic modifiers which may be used includes:

1. additives which are not thixotropic in themselves but which precipitate a thixotropy inducing agent, for example, aluminum iso-propoxide, aluminum methoxide, aluminum ethoxide and aluminum propoxide.

2. additives which again are not thixotropic in themselves but which will react with the moisture content of the slurry and precipitate a thixotropic inducing agent, for example, aluminum alkyls and aryls, which it should be mentioned present a fire hazard.

Other thixotropic modifiers are aluminum aryloxides such as aluminum phenoxide and its homologues, but these substances are toxic.

I claim:

1. A method of forming a foundry mould, comprising:

a. applying an initial coating of refractory particles, to a meltable mould former, from a slurry having a suspended solids content in the range 30 to 50% by volume of the total volume of the slurry, and containing a siliceous binder for the refractory particles and a thixotropic modifier for the slurry, then b. applying additonal refractory particles to the mould former, in the form of a stucco layer of relatively coarser refractory particles, then c. applying a plurality of further coatings of refractory particles to the mould former to form a foundry mould, the further coatings comprising slurry coatings alternating with stucco layers of relatively coarser refractory particles, with each slurry coating being applied from a slurry having a suspended solids content is the range 20 to 40% by volume of the total volume of the slurry, and containing a siliceous binder for the refractory particles and a thixotropic modifier for the slurry, then . allowing the coatings and layers to set and dry, and then . heating the mould former to melt it and then removing the molten mould former material from the foundry mould, and wherein the thixotropic modifier comprises particles of at least one substance selected from the group consisting of aluminum alkoxides, aluminum aryloxides, clays, carbon blacks, fumed silicas, fumed alumina, fumed titanium oxide, fumed zirconium oxide, fumed hafnium oxide and fumed chromium oxide.

2. A method according to claim 1, wherein a major portion of the thixotropic modifier comprises particles thereof less than 10 microns in size.

3. A method according to claim 1, wherein for each slurry, the amount of thixotropic modifier present is inversely proportional to the suspended solids content therein and for each liter of slurry is in the range 3 gms to 70 gms.

4. A method according to claim 1, wherein the slurries from which the further coatings are applied contains 5 to 10 ml of hydrochloric acid per liter of slurry.

5. A method according to claim 1, wherein the carbon black is acetylene black.

6. A method according to claim 1, wherein the thixotropic modifier is an aluminum akoxide and an alcohol tolerant colloidal silica is used as the binder.

* * * * *